US008316953B2

(12) United States Patent
Reid et al.

(10) Patent No.: US 8,316,953 B2
(45) Date of Patent: Nov. 27, 2012

(54) VALVE

(75) Inventors: Michael A. Reid, Aberdeen (GB); Irvine C. Brown, Aberdeen (GB)

(73) Assignee: Red Spider Technology Limited, Westhill, Aberdeen (GB)

( * ) Notice: Subject to any disclaimer, the term of this patent is extended or adjusted under 35 U.S.C. 154(b) by 512 days.

(21) Appl. No.: 11/884,976

(22) PCT Filed: Feb. 27, 2006

(86) PCT No.: PCT/GB2006/000669

§ 371 (c)(1),
(2), (4) Date: Sep. 26, 2008

(87) PCT Pub. No.: WO2006/090168

PCT Pub. Date: Aug. 31, 2006

(65) Prior Publication Data

US 2009/0071658 A1 Mar. 19, 2009

(30) Foreign Application Priority Data

Feb. 26, 2005 (GB) ..... 0504055.5

(51) Int. Cl.
*E21B 34/10* (2006.01)
*F16K 5/00* (2006.01)

(52) U.S. Cl. ..... 166/375; 166/330; 166/331; 251/230; 251/315.11; 251/315.16

(58) Field of Classification Search ..... 166/375, 166/330, 331; 251/315.1, 315.11, 315.6, 251/230, 315.16
See application file for complete search history.

(56) References Cited

U.S. PATENT DOCUMENTS

| | | | |
|---|---|---|---|
| 2,042,817 | A | 6/1936 | Wilcox |
| 2,599,774 | A | 6/1952 | Ohls |
| 2,710,655 | A | 6/1955 | Collett |
| 2,883,146 | A | 4/1959 | Knox |
| 2,916,254 | A | 12/1959 | Wendell |
| 3,061,267 | A | 10/1962 | Hamer |
| 3,072,379 | A | 1/1963 | Hamer |
| 3,241,808 | A | 3/1966 | Allen |
| 3,395,758 | A | 8/1968 | Kelly et al. |
| 3,424,190 | A | 1/1969 | Wolfensperger |

(Continued)

FOREIGN PATENT DOCUMENTS

CA 2 485 810 4/2005

(Continued)

OTHER PUBLICATIONS

International Preliminary Report dated Aug. 28, 2007.

(Continued)

*Primary Examiner* — Jennifer H Gay
(74) *Attorney, Agent, or Firm* — Ladas & Parry LLP

(57) ABSTRACT

A well tubing valve including a substantially tubular body connected in a tubular string and a rotational valve member having at least one aperture. The valve member is a sleeve having a part spherical surface, is rotationally moveable relative to the body to align and misalign the at least one aperture in the valve member with a port in the body. The valve member is actuable to rotate relative to the body in a single direction, and moves from the open position to a closed position and back by rotation in the same sense. The valve also includes a sealing arrangement adapted to provide a metal seal that is biased to seal against the part spherical surface.

22 Claims, 6 Drawing Sheets

U.S. PATENT DOCUMENTS

| | | | | | |
|---|---|---|---|---|---|
| 3,472,484 | A | | 10/1969 | Parker | |
| 3,581,820 | A | | 6/1971 | Burns | |
| 3,815,676 | A | | 6/1974 | Read | |
| 3,960,363 | A | | 6/1976 | Domyan | |
| 3,993,130 | A | | 11/1976 | Papp | |
| 4,022,426 | A | * | 5/1977 | Read | 251/340 |
| 4,022,427 | A | | 5/1977 | Read | |
| 4,029,292 | A | | 6/1977 | Kramer et al. | |
| 4,080,982 | A | | 3/1978 | Maezawa | |
| 4,315,542 | A | | 2/1982 | Dockins, Jr. | |
| 4,355,685 | A | * | 10/1982 | Beck | 166/240 |
| 4,406,335 | A | | 9/1983 | Koot et al. | |
| 4,506,693 | A | | 3/1985 | Acker | |
| 4,519,579 | A | | 5/1985 | Brestel et al. | |
| 4,606,368 | A | | 8/1986 | McCafferty | |
| 4,616,857 | A | | 10/1986 | Woodman et al. | |
| 4,700,924 | A | | 10/1987 | Nelson et al. | |
| 4,709,762 | A | | 12/1987 | Pringle et al. | |
| 4,747,578 | A | * | 5/1988 | Kivipelto et al. | 251/159 |
| 4,776,395 | A | | 10/1988 | Baker et al. | |
| 4,782,896 | A | | 11/1988 | Witten | |
| 4,815,701 | A | | 3/1989 | Stone | |
| 4,921,044 | A | | 5/1990 | Cooksey | |
| 4,949,788 | A | | 8/1990 | Szarka et al. | |
| 5,263,683 | A | | 11/1993 | Wong | |
| 5,316,084 | A | | 5/1994 | Murray et al. | |
| 5,529,126 | A | * | 6/1996 | Edwards | 166/331 |
| 5,615,548 | A | * | 4/1997 | Winfree et al. | 60/39.78 |
| 5,794,699 | A | * | 8/1998 | Hammett et al. | 166/332.3 |
| 5,865,246 | A | | 2/1999 | Brown | |
| 5,911,285 | A | | 6/1999 | Stewart et al. | |
| 6,003,834 | A | | 12/1999 | Read | |
| 6,044,908 | A | | 4/2000 | Wyatt | |
| 6,276,458 | B1 | * | 8/2001 | Malone et al. | 166/386 |
| 6,308,783 | B2 | * | 10/2001 | Pringle et al. | 166/320 |
| 6,450,255 | B2 | | 9/2002 | Carmody et al. | |
| 6,668,936 | B2 | * | 12/2003 | Williamson et al. | 166/375 |
| 6,715,558 | B2 | | 4/2004 | Williamson | |
| 6,776,240 | B2 | | 8/2004 | Kenison et al. | |
| 6,782,952 | B2 | | 8/2004 | Garay et al. | |
| 6,860,330 | B2 | | 3/2005 | Jackson | |
| 6,880,638 | B2 | * | 4/2005 | Haughom et al. | 166/316 |
| 6,951,331 | B2 | * | 10/2005 | Haughom et al. | 251/180 |
| 6,974,121 | B2 | | 12/2005 | Koester et al. | |
| 7,258,323 | B2 | | 8/2007 | Dwivedi | |
| 7,306,043 | B2 | * | 12/2007 | Toekje et al. | 166/375 |
| 7,836,909 | B2 | * | 11/2010 | Church | 137/15.22 |
| 2002/0046845 | A1 | * | 4/2002 | Rayssiguier et al. | 166/375 |
| 2002/0053438 | A1 | * | 5/2002 | Williamson, Jr. | 166/373 |
| 2003/0047702 | A1 | * | 3/2003 | Gunnarsson et al. | 251/297 |
| 2004/0035578 | A1 | | 2/2004 | Ross et al. | |
| 2004/0041120 | A1 | * | 3/2004 | Haughom et al. | 251/344 |
| 2004/0046143 | A1 | * | 3/2004 | Haughom et al. | 251/304 |
| 2004/0112608 | A1 | | 6/2004 | Jackson | |
| 2004/0154839 | A1 | * | 8/2004 | McGarian et al. | 175/324 |
| 2005/0087344 | A1 | * | 4/2005 | Toekje et al. | 166/375 |
| 2005/0151107 | A1 | * | 7/2005 | Shu | 251/214 |
| 2008/0203346 | A1 | * | 8/2008 | Shu | 251/214 |
| 2008/0315144 | A1 | * | 12/2008 | Thomas | 251/315.1 |
| 2009/0050335 | A1 | * | 2/2009 | Mandrou | 166/386 |
| 2009/0071658 | A1 | * | 3/2009 | Reid et al. | 166/373 |

FOREIGN PATENT DOCUMENTS

| | | |
|---|---|---|
| EP | 0 427 371 | 5/1991 |
| EP | 1 136 649 | 9/2001 |
| EP | 1 350 007 | 10/2005 |
| EP | 1 350 008 | 10/2005 |
| GB | 939999 | 10/1963 |
| GB | 2 201 979 | 9/1988 |
| GB | 2 293 433 | 3/1996 |
| GB | 2 344 152 | 5/2000 |
| GB | 2 377 743 | 1/2003 |
| GB | 2 396 633 | 6/2004 |
| WO | WO 01/86113 | 11/2001 |
| WO | WO 03/001019 | 1/2003 |
| WO | WO 2004/057689 | 7/2004 |
| WO | WO 2005/052302 | 6/2005 |
| WO | WO 2005/052313 | 6/2005 |

OTHER PUBLICATIONS

International Search Report dated Jun. 14, 2006.
Fisher Product Bulletin—"Type Vee-Ball Designs V150, V200 and V300 Rotary Control Valves", Apr. 2005.

* cited by examiner

VALVE

CROSS REFERENCE TO RELATED APPLICATIONS

This application is the U.S. national phase, pursuant to 35 U.S.C. §371, of International Application No. PCT/GB2006/000669, published in English on Aug. 31, 2006 as International Publication No. WO 2006/090168 A1, which claims the benefit of British Application Ser. No. GB 0504055.5, filed Feb. 26, 2005. The content of each of the above-mentioned applications are incorporated by reference herein.

BACKGROUND OF THE INVENTION

1. Field of the Invention

The present invention relates to valves typically used on downhole tools in oil and gas wells and in particular, though not exclusively, to a zonal control valve to regulate production flow rate from several hydrocarbon bearing zones within a well.

2. Description of Related Art

In the drilling of oil and gas wells, well bores are now typically drilled in a deviated path so that the well intersects as many hydrocarbon bearing zones over the greatest distances possible. By perforating the well casing or tubing at each zone or across a zone, the well can be produced at a number of locations simultaneously and thereby maximise production. However, this simultaneous production requires to be carefully controlled as production will flow from one zone to another zone rather than to surface, if the pressure between each zone varies.

Prior art flow control systems have been based on inserting production tubing into the well with packers between each of the producing zones. At each zone, a valve is located in the tubing, to allow production to flow from the zone into the tubing and up to surface. Typically only a single zone is produced at a time to prevent cross-talk. If more than one zone is produced at a time, the pressures between the zones must be balanced. This is achieved by locating a valve at each zone with each valve has a selected size of orifice or opening so that the flow rate through each valve is equalised into the tubing. A control line, typically hydraulic, is run to each valve and the valves are then opened as required.

There are a number of disadvantages of such control systems. In order to use a number of valves, the flow rate from each zone must be determined. This is not a simple task as flow rates from each zone can vary. The valves are then selected on the basis of the required flow rate in the tubing and these valves must be correctly positioned on the tubing in the well. Once positioned, these valves are either 'on' or 'off', so that no adjustment of the flow rate through the valve can be made when the valve is downhole. Any changes in the flow rate from a zone result in either the respective valve having to be closed which losses production from the zone, or the tubing must be removed so that the valve can be replaced and the tubing run back in the well. This causes downtime in production. Additionally a control line is required for each valve, with each control line having to be run to surface, operated and monitored individually.

U.S. Pat. No. 6,782,952 proposes a stepping valve which allows the valve to be incrementally opened or closed. This provides selective throttling of the flow downhole.

While this valve has this advantage, it also has a number of disadvantages. The valve is based on a hydraulically actuated sliding sleeve. An inherent problem in sliding sleeve valves is that these valves are long devices. This is because there must be sufficient length in the tool as the sleeve must be able to move longitudinally across a stroke distance between the open and closed positions of the valve. Additionally, this valve requires two control lines to operate. Thus in a well having a number of zones, valuable space is required to run two control lines to each valve at each zone.

SUMMARY OF THE INVENTION

It is an object of the present invention to provide a well tubing valve which provides production control over at least two zones from a single control line.

It is a further object of at least one aspect of the present invention to provide a well tubing valve which provides selective throttling over at least two zones.

Further aims and objects will become apparent from the following description.

According to a first aspect of the invention there is provided a well tubing valve comprising a substantially tubular body having first and second ends adapted for connection in a tubular string; a valve member having at least one aperture and being rotationally moveable relative to the body to align and misalign said aperture in the valve member with a port in the body to move the valve between an open position and a closed position, wherein the valve member is actuable to rotate relative to the body in a single direction.

By providing a valve member that rotates in only one direction, the valve can be actuated from a single control line in a single direction. That is, there is no requirement for a double-acting actuator, and no need for a reverse direction. In a hydraulic embodiment, this avoids the need for a return line.

Preferably, the valve member is a sleeve.

Preferably, the valve member includes a pair of apertures. More preferably, the apertures are radially oriented and diametrically opposed on the valve member.

Preferably, the body includes a pair of ports. The ports may be radially oriented and diametrically opposed on the body.

According to a second aspect of the present invention there is provided a well tubing valve, the valve comprising a substantially tubular body having first and second ends adapted for connection in a tubing string; first and second ports located through the body and spaced longitudinally apart; first and second valve members located in the body at the respective ports, each valve member being actuable to at least three operating positions to incrementally adjust flow through the respective port and the valve members being actuable from a common control line.

In this way a single pressure pulse from the surface can cause the valve members to move to one of the three operating positions. The positions may be open, closed or at an incremental value therebetween.

Preferably the valve members are sleeves including one or more apertures. The degree of overlap between the apertures and the respective ports determines the amount of fluid flow into the tubing.

More preferably the sleeves rotate when actuated. In this way the tool is inherently short as the sleeves do not require to slide. Further, by rotating the sleeves, there is no requirement for a double acting actuator as there is no need for a reverse direction.

Advantageously each sleeve includes a part spherical surface. This surface may locate on a complimentary surface of the body. This may be considered as a ball valve or ball choke. Advantageously, the part spherical surface locates against a metal seal ring, biased toward the sleeve. In this way, a metal to metal seal can be formed with constant axial loading in use.

Preferably, the first valve member has a different number of operational positions than the second valve member. These operational positions may be set by the number of degrees turned by the sleeve on each increment. Preferably the degree increment is a whole divisor of 360 degrees. In this way, each sleeve returns to the same operating position on a full rotation, but they will rotate at different rates. Advantageously the degree increment is selected for each sleeve such that operating positions will exist where both valve members are 'open', closed and throttled by different amounts.

Preferably the common control line is a hydraulic line which connects the two valve members to the surface of the well. The valves may then be operated by successive pressure pulses in a cyclic manner. It will be appreciated that any hydraulically operated actuating mechanism can be used to rotate each of the valve members.

The well tubing valve may further comprise one or more isolation packers. Most preferable a packer is located between each of the ports to isolate the ports from each other.

According to a third aspect of the present invention there is provided a method of controlling fluid flow from hydrocarbon bearing zones in a well bore, comprising the steps:

(a) locating a well tubing valve across two hydrocarbon producing locations in a well bore;
(b) providing a seal between the locations to isolate one from the other;
(c) sending a control signal down a control line to the well tubing valve;
(d) actuating two valve members together to cause the valve members to move by unequal amounts to thereby vary the fluid flow from each location into the well tubing valve;
(e) repeating steps (c) and (d) until both valve members are open;
(f) repeating steps (c) and (d) until both valve members are closed; and
(g) repeating steps (c) and (d) until both valve members are incrementally opened to produce a desired flow rate through each valve member.

Preferably actuation of the valve members causes them to rotate within the well tubing valve.

More preferably the method may be cyclic so that the combination of valve member positions is repeatable over a predetermined number of control signals.

The control signal may be a pressure pulse. In this way, the control line may be a hydraulic fluid line. Alternatively the control signal may be an electrical signal passed down a transmission line or may be an acoustic signal passed down the production tubing or well fluid.

While the terms 'up', 'down', 'top' and 'bottom' are used within the specification, they should be considered as no more than relative, as the valve of the present invention may be used in any orientation to suit the deviation of the well.

According to a fourth aspect of the invention there is provided a well tubing valve comprising a substantially tubular body having first and second ends adapted for connection in a tubular string; an valve member having at least one aperture and being rotationally moveable relative to the body to align and misalign said aperture in the valve member with a port in the body to move the valve between an open position and a closed position, wherein the valve member is actuable to move from an open position to a closed position, and back to an open position by rotation in a single direction.

BRIEF DESCRIPTION OF THE DRAWINGS

Embodiments of the invention will now be described by way of example only with reference to the accompanying figures in which.

DETAILED DESCRIPTION OF PREFERRED EMBODIMENTS

Figure 1:
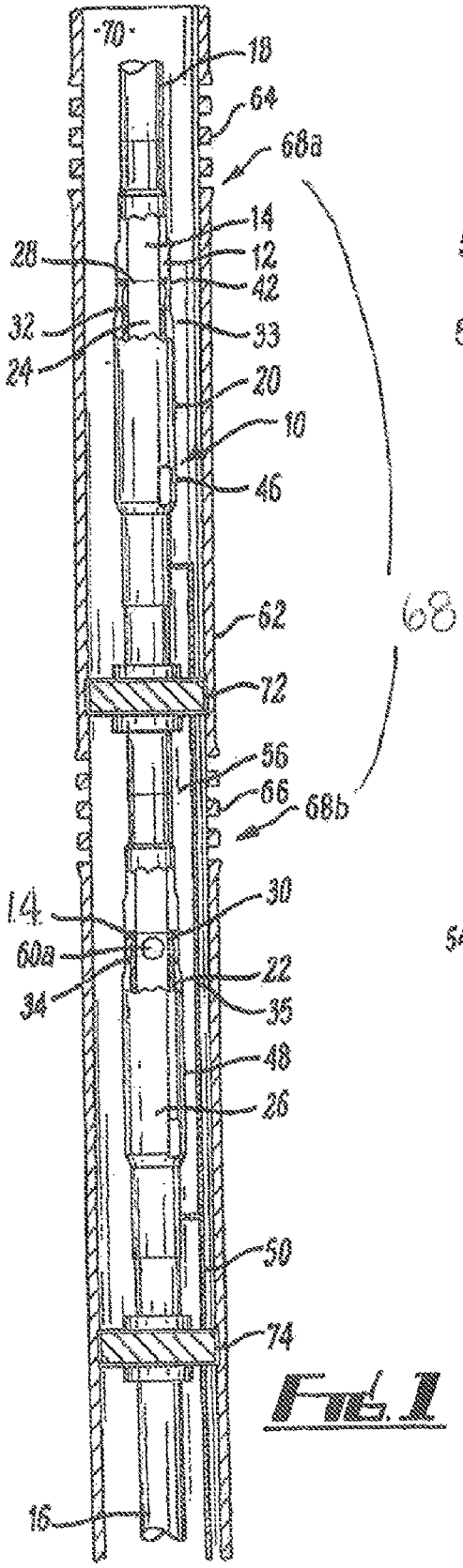
FIG. 1 is an illustration of a well tubing valve according to a first embodiment of the present invention.

Referring initially to FIG. 1 of the drawings there is illustrated a well tubing valve, generally indicated by reference numeral 10, according to a first embodiment of the present invention. Well tubing valve 10 comprises a cylindrical body 12 and a bore 14 therethrough. Body 12 connects to a tubing string (not shown) at an upper 16 and lower 18 end respectively. Located within the body 12 are two sleeves 20, 22. Sleeves 20 and 22 provide co-linear throughbores 24, 26 respectively so that the valve 10 provides a clear passage for fluid to flow between the upper 16 and lower 18 ends of the valve 10.

At an end 28, 30 of each of the sleeves 20, 22 respectively, there is located a ball or spherical section 32, 34. Each ball 32, 34 includes an axial bore to maintain fluid flow through the sleeve 20, 22. Additionally each ball 32, 34 has oppositely arranged apertures 58*a*, 58*b* and 60*a*, 60*b* which are perpendicular to the axis through the valve 10. These apertures 58, 60 provide a passageway from the through bores 24, 26 to the body 12.

Figure 3A:
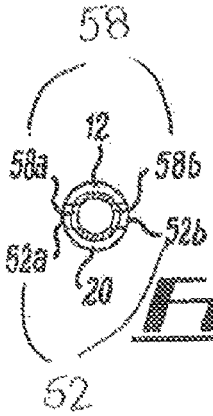
FIGS. 3(*a*) and (*b*) are sectional views through the valve members of the well tubing valve of FIG. 1.
Figure 3B:
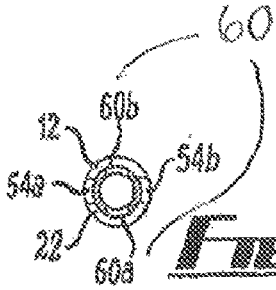

On the body 12 at the location of the balls 32, 34 are ports 52*a*, 52*b*, 54*a*, 54*b* arranged through the wall of the body 12. The sets of ports 52, 54 are longitudinally separated on the valve 10. Each set of ports 52, 54 provides two oppositely arranged passageways between the outside 56 of the valve 10 and the bore 14. There may be any number of ports, one or more at each of the locations of the sleeves 20, 22. These ports are best seen with the aid of FIGS. 3(*a*) and 3(*b*). As the ports 52,54 are located at the balls 32,34, fluid can travel from the outside of the valve 10 to the inner bore 14 when the ports 52,54 and the apertures 58,60 align. This arrangement provide a pair of ball valves, providing radial ports, generally indicated at 33 and 35.

Reference is now made to FIGS. 2(*a*) and (*b*) of the drawings which illustrate the ball valve 33, 35 arrangement. This arrangement is identical for both ball valves 33, 35 and thus only one is described for illustrative purposes. Ball valve 35 comprises the ball 34 on the end of sleeve 22 located with the body 12 at the ports 54. At the aperture 54 there is located an annular retainer ring 42, threaded in place. The ring 42 has located therein, on the bore 14 side, a Belleville® washer 80, being a spring washer, located against a floating piston ring 82 and a sleeve ring 84. The piston ring 82 can act against a lower portion of the sleeve ring 84, such that a carbide seal ring 86, on the lower edge of the sleeve ring 84, is held against the ball 34. Arrangements, 88*a-c*, of back-up rings 90 around o-rings 92 provide seals between the piston ring 82 and the retainer ring 42; the piston ring 82 and the sleeve ring 84; and the retainer ring 42 and the body 12. The retainer ring 42 and the arrangements therein ensure that a metal to metal seal is always maintained between the ball 34 and the body 12 via the carbide ring 86. This is achieved as the sleeve ring 84 is biased toward the ball 34 regardless of the differential pressure across the seal ring 86, as the piston ring 82 is 'floating' and exposed to the fluid. Thus in low pressure the Belleville® washer 80 will act on the sleeve ring 84 to force it toward the ball 34 while in high pressure the fluid will act directly on the sleeve ring 84 on the face under the piston ring 82.

The balls 32, 34 and the carbide seal rings 86 all have complimentary spherical surfaces so that the balls can rotate on the seals without the seal being broken.

Located between each sleeve 20, 22 and the body 12 is an indexing mechanism 46, 48. Such mechanisms are known to the skilled person and operate by the injection of fluid from a control line 50. Control line 50 is a hydraulic fluid line which runs from the surface to the valve 10 and commonly transmits a pressure pulse to each of the indexing mechanisms 46, 48 at the same time with a uniform pressure. Each indexing mechanism 46, 48 will cause the respective sleeve 20, 22 to rotate within the body 12. This will happen uniformly at the same time. The indexing mechanisms 46, 48 will rotate the sleeves 20, 22 in incremental steps pre-set by their design.

In the embodiment shown in FIG. 1, the sleeve 20 is set to rotate in response to a pulse from the control line 50 in 20° incremental steps. In this way it will take eighteen movements for the sleeve to move from an initial start position to an end position where the sleeve 20 is returned to its original position having traveled through one complete rotation. The sleeve 22 moves by a differing number of incremental steps. It is important in the context of this embodiment that the incremental steps on sleeve 20 and sleeve 22 are unequal. Sleeve 22 moves in 30° incremental steps, thus repeating its pattern every twelve steps. Sleeve 22 will have moved one entire revolution within the body 12 to return to its initial starting position within these twelve steps.

In use, the valve 10 will be introduced into a well bore which, as illustrated in FIG. 1, will be cased 62 and include perforations 64, 66 to allow fluid, in the form of hydrocarbons, to flow from the outside 68 of the casing 62 to the bore 70 of the well. The location of the perforation 64, 66 will have been chosen so that differing hydrocarbon bearing zones 68*a*, 68*b* are exposed to the bore 70. A tool string is then run into the well bore 70, upon which valve 10 is located. Between the sleeves 20 and 22 on valve 10, there will be located a zonal isolation packer 72. Similar zonal isolation packers 74 may also be located at opposing ends of the sleeves 20, 22 as desired. These packers 72,74 are as known in the art for sealing an annulus in a well bore. Packer 72 is set between the perforations 64, 66 and thus isolates the zones 68*a* and 68*b* from each other. In addition a packer 74 may be used to provide further isolation points between the zones 68*a* and 68*b* and other positions in the well bore.

Figure 4:
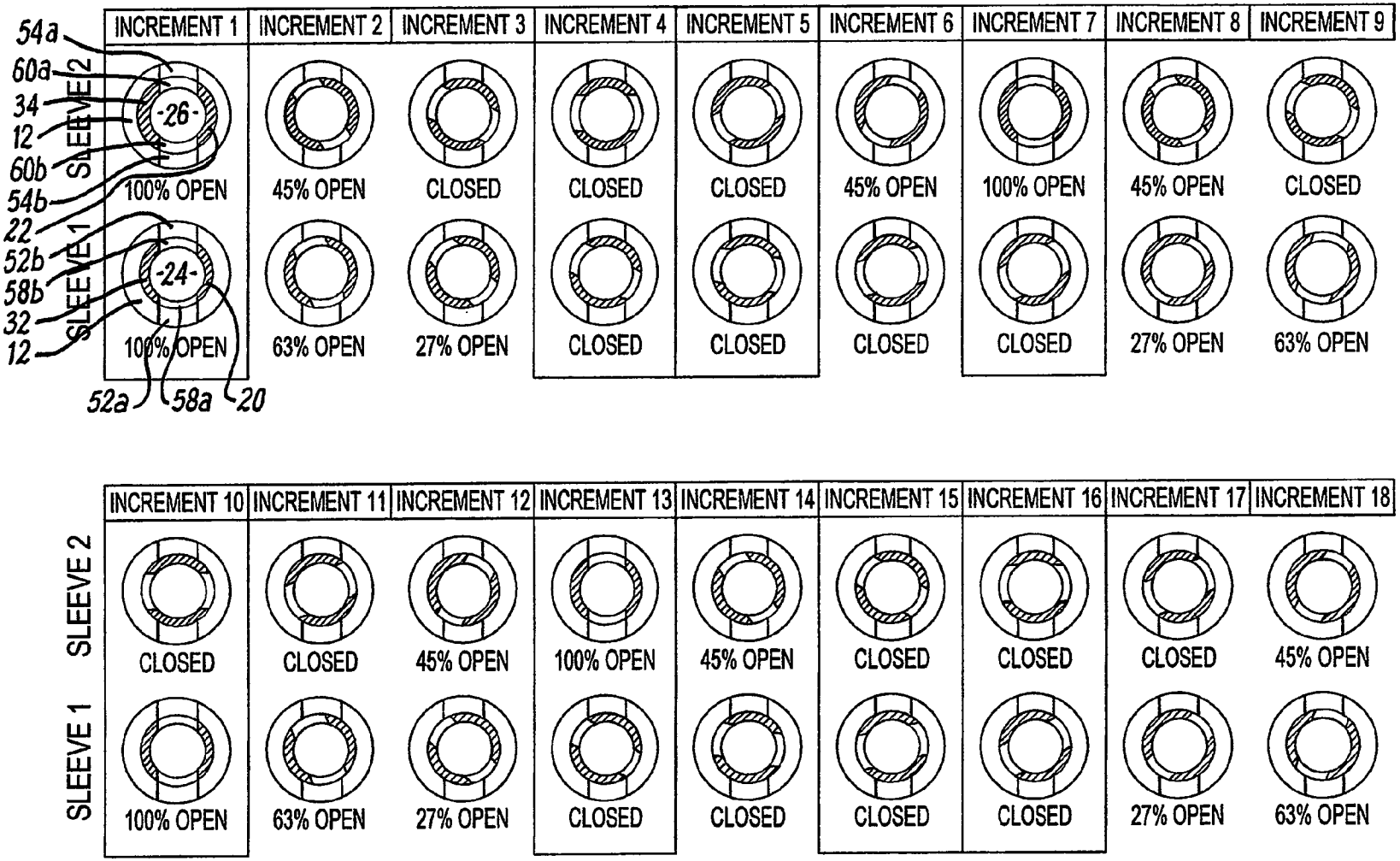
FIG. 4 is a chart illustrating the operating positions of the well tubing valve of FIG. 1.

When run into the well, the valve 10 will be set in an open or closed configuration. In the embodiment shown the valve 10 is located in the well in open configuration. This is as illustrated in FIG. 4 marked 'increment 1'. In the open configuration the apertures 58, 60 are aligned with the ports 52, 54. Fluid will thus flow from each zone 68*a*, 68*b* into the bore 70 and through the ports 52, 54 and apertures 58, 60 to access the bore 14 of the string whereupon it can travel to the surface of the well for processing.

Once the valve 10 is in place and the packers 72, 74 are set, the operator can then select the required degree of throttling or flow-through in each of the sleeves 20, 22 for each respective zone 68*a*, 68*b* by sending sequential pulses down the control line 50. As shown in FIG. 4 each pulse from the common control line 50 will cause the sleeves 20, 22 and their respective balls 32, 34 to rotate along the body 12 by the stepped increments set in each of the indexing mechanisms 46, 48. Thus as illustrated, with a single pressure pulse, ball 34 and sleeve 22 will rotate by 30° relative to the body 12. This causes a mismatch between the apertures 60 and the ports 54. It results in a narrower passage for fluid flow from the zone 68*b* at the outside 56 in the bore 70 to the inner bore 26 of the sleeve 22. This thus throttles the flow and may be referred to as the 45% open position. This throttling adjusts the flow rate of production from the zone 68*b*.

At the same time, this same pressure pulse will have caused the indexing mechanism 46 to rotate the sleeve 20 through 20° forming a 63% open position. Here the apertures 58 are again misaligned with the ports 52, but to not the same extent as for the sleeve 22, and thus a higher flow rate is achieved through the ball valve 32 than that of the ball valve 34.

A further pressure pulse causes the sleeves 20, 22 to rotate once more. Now the sleeve 22 is rotated to such a position that although the aperture 60 and ports 54 are misaligned there is no clear passage and this ball valve 34 is now closed. By virtue of the shorter rotation of the sleeve 20, the ball valve 32 is still open but in a substantially throttled position. This is referred to as the 27% overlap position by virtue of the orientation of the sleeve 20 and the body 12. In this location a smaller cross-sectional area is present through which the production fluid can flow.

A yet further pulse provides the fourth increment so both the valves 32, 24 are now closed due to misalignment of the apertures 58, 60 to the ports 52, 54. A further increment, increment 5, has the valves still in the closed position.

It can be seen from FIG. 4 that each sequential increment causes further rotation of the sleeves 20, 22 and adjusts the relative positions of the apertures 58, 60 with respect to the ports 52, 54. In this embodiment, sleeve 22 can move through a complete revolution following twelve pulses, although as the ports 54 and apertures 60 are asymmetrical the valve will be fully open again after six increments. For sleeve 20, 18 pulses are required to move the valve back to the original open position. Thus in FIG. 4 it should be noted that when the valve is at the eighteenth increment a further pressure pulse will return the valve to 'increment 1'. Thus the system is fully cyclic and any combination shown on FIG. 4 is attainable by repeatedly sending a pulse down the control line. In this way selective throttling is obtained from each of the zones 68*a* and 68*b*. Additionally the valves 32, 34 can be operated independently such that a valve is closed while another valve is open. In this way a single zone 68*a* or 68*b* can be produced and the other zone remains sealed off. All movements of the valves are of course in real time, thus valve 10 would find use within a SMART well solution.

The foregoing description relates to a valve comprising a pair of longitudinally displaced valve members and its use in incrementally controlling production flow. However, the invention in another of its aspects relates to a valve having a single valve member, described with reference to FIG. 5.

Figure 5:
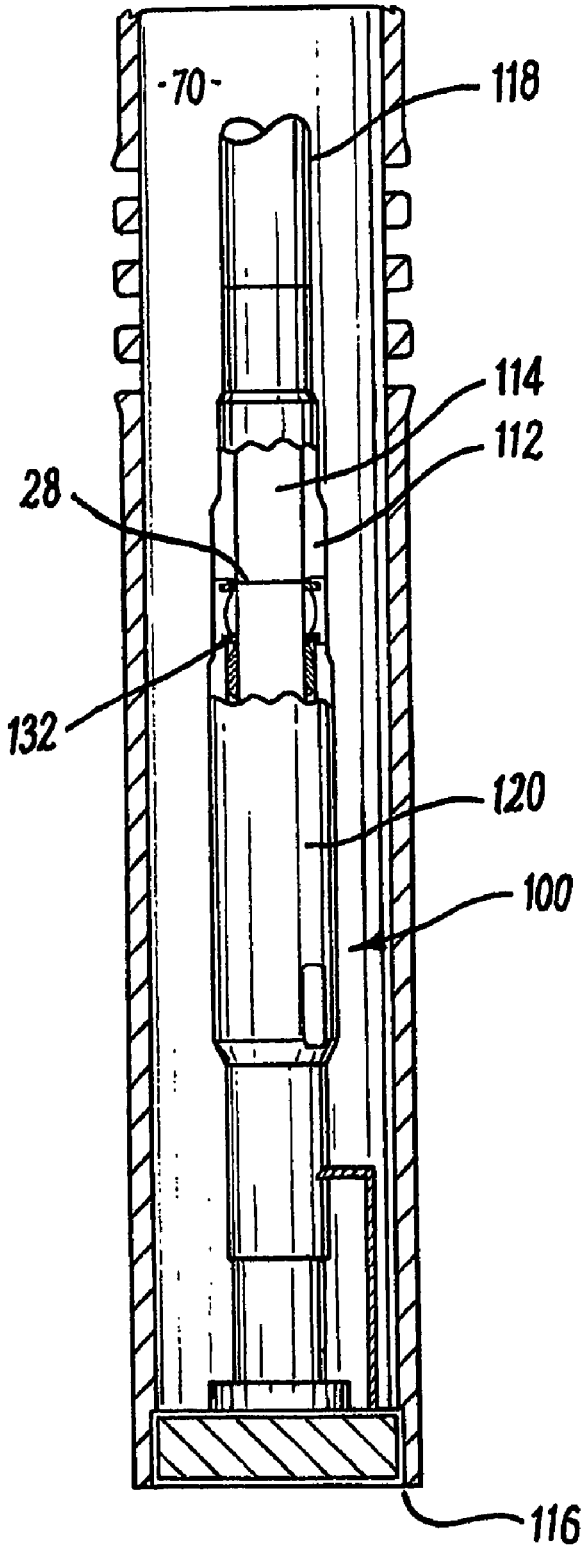
FIG. 5 is an illustration of a well tubing valve according to a second embodiment of the present invention.

FIG. 5 illustrates a well tubing valve, generally depicted at 100, comprising a cylindrical body 112 and a bore 114 therethrough. Body 112 connects to a tubing string (not shown) at upper 116 and lower 118 ends respectively. Located within the body 112 is a sleeve 120, defining a throughbores 124 providing a clear passage for fluid to flow between the upper 116 and lower 118 ends of the valve 100. The valve is similar to a single one of the two valve assemblies provided in the embodiment of FIGS. 1 to 4, and is similarly provided with a ball or spherical section 132. The ball 132, 34 includes an axial bore to maintain fluid flow and oppositely arranged apertures 158*a*, 158*b* which are perpendicular (radial) to the axis through the valve 100. These apertures 158 provide a passageway from the throughbore 124 to the body 112, and as most clearly seem in FIG. 6, rotation of the sleeve 120 relative to the body causes alignment or misalignment of apertures 158 with the ports 152*a*, 152*b* provided in the body 112.

In this embodiment, the valve is provided with two apertures 158*a*, 158*b* and two corresponding ports 152*a*, 152*b*, although any number of apertures and ports may be provided in alternative embodiments.

Figure 6:
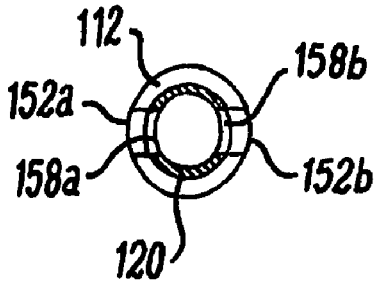
FIG. 6 is a section view through the valve member of the embodiment of FIG. 5.
Figure 7:
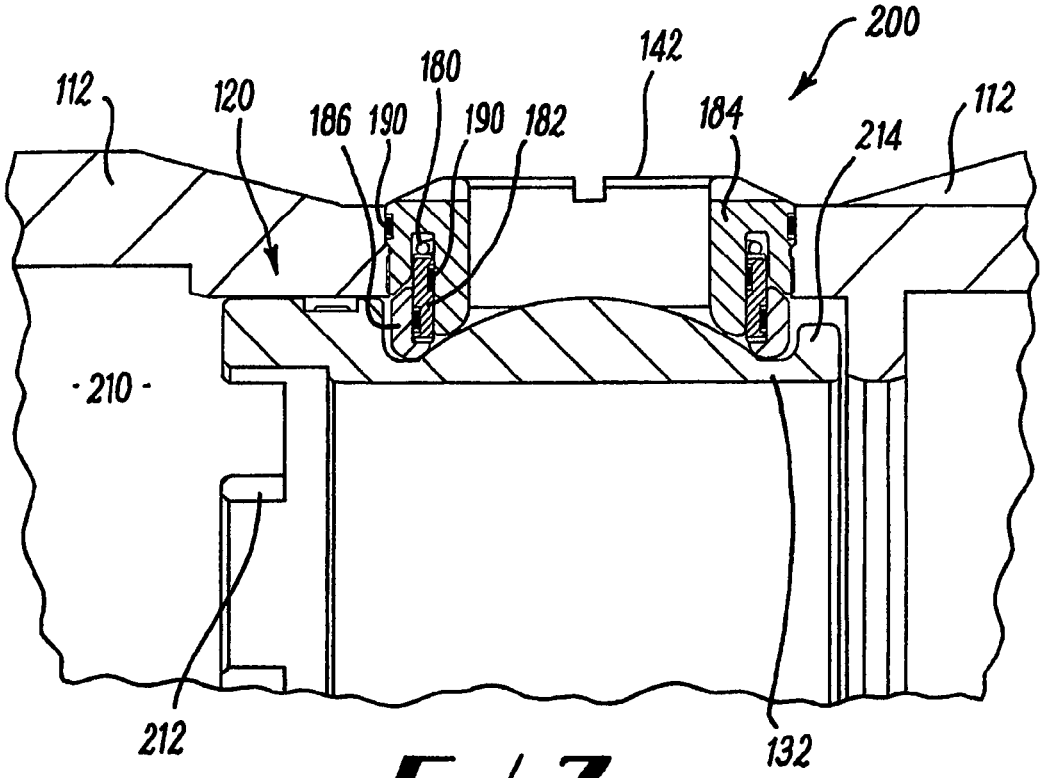
FIG. 7 is a sectional view through the sealing arrangement of the valve of FIG. 5.

FIG. 7 shows in more detail the sealing arrangement, generally depicted at 200, of the embodiment of FIGS. 5 and 6. The sleeve 120 consists of a main section 210 and a ball section 132, connected by a clutch mechanism 212. The lower (distal) end of the ball section 132 comprises a flange portion 214 to provide additional structural strength and resistance to deformation of the ball section.

Figure 2A:
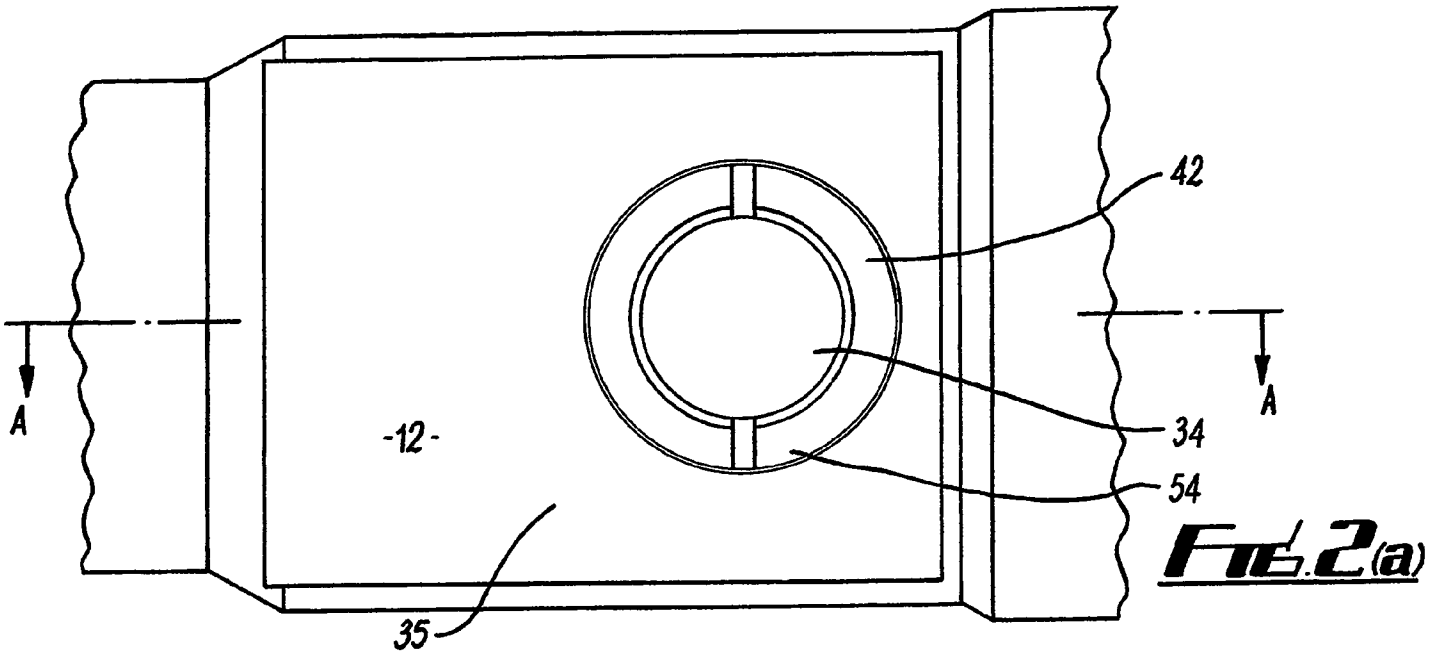
FIGS. 2(*a*) and (*b*) are expanded views of a valve member within the well tubing valve of FIG. 1.
Figure 2B:
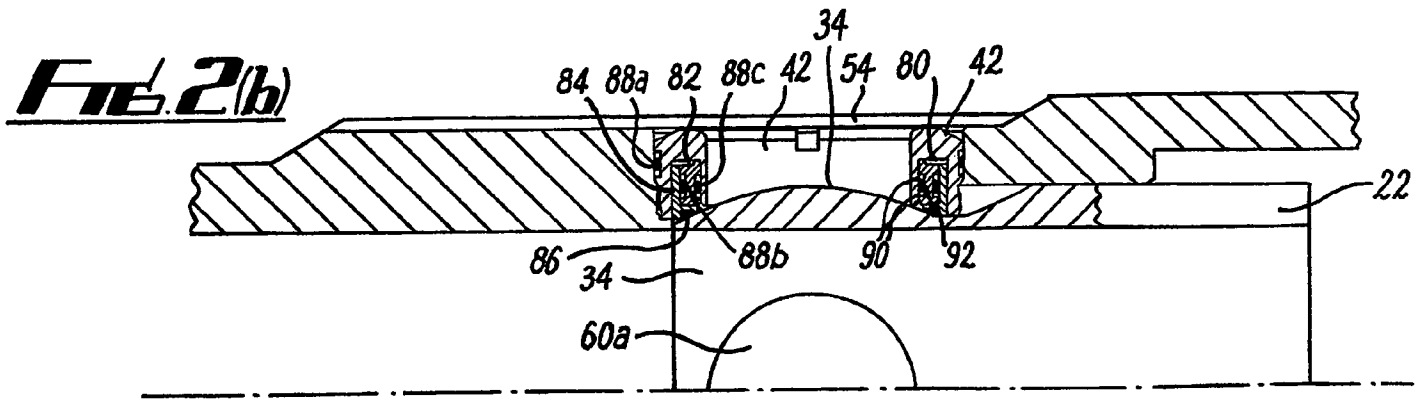

The sealing arrangement 200 is similar to that shown in FIGS. 2*a* and 2*b*, and comprises an annular retainer ring 142, sleeve ring 184, a floating piston ring 182 and a seal ring or seat 186. O-ring seals 190 are also provided. The sealing arrangement 200 is such that the floating piston ring 182 is disposed between the sleeve ring 184 and a bearing surface on the seat 186. A wave spring 180 bears on the sleeve ring and the upper surface of the piston ring 182, which in turn acts to urge the seat into contact with the ball section 132.

The seat 186 is has on its lower face a circular ring (not shown) which provides a "seal point" on the ball section 132. The location of the seal point is important as it defines the manner in which the sealing arrangement provides a seal under opposing differential pressures.

Figure 8A:
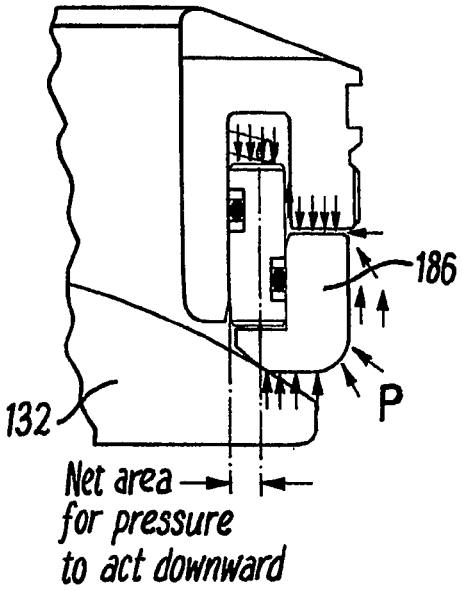
FIGS. 8*a* and 8*b* show the operation of the sealing arrangement of the embodiment of FIG. 5.
Figure 8B:
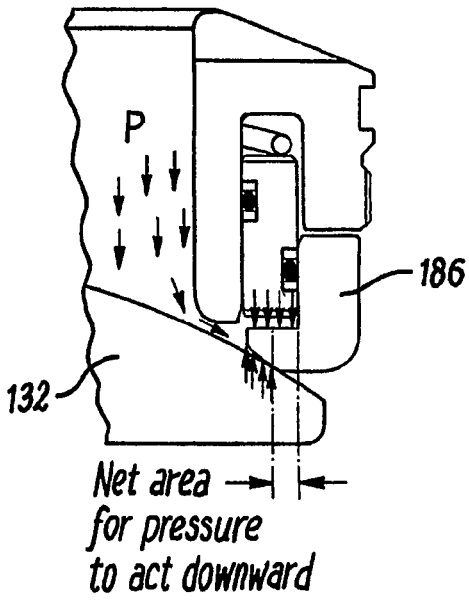

FIGS. 8*a* and 8*b* show how the sealing arrangement operates in opposing different pressure regimes. In FIG. 8*a*, an internal differential pressure creates a net area of downward pressure on the seat 186, forming a seal on the ball section 132. In FIG. 8*b*, an external differential pressure also creates a net area of downward pressure on the seat 186, forming a seal on the ball section 132. This sealing function in the two opposing pressure regimes is due to the positioning of the seal point between the o-rings on the floating piston 186.

It is important to note that the wave spring 180 functions to ensure that the seat 186 is in contact with the ball section 132, to allow the hydraulic pressure to take over and provide the seal. The wave spring 180 has a negligible contribution to the sealing load, and is used to take account of any tolerance variations in the assembly. The wave spring does not provide a large force on the seat and thus avoids high friction loads when rotating the ball section.

Figure 9:
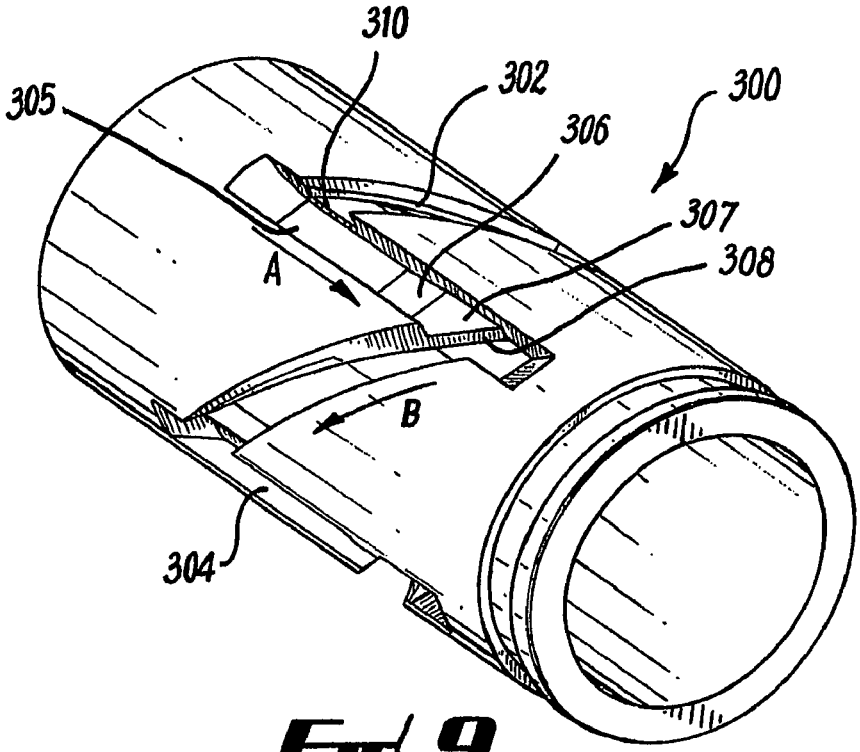
FIG. 9 is a perspective view of an indexing sleeve according to an embodiment of the invention.
Figure 10:
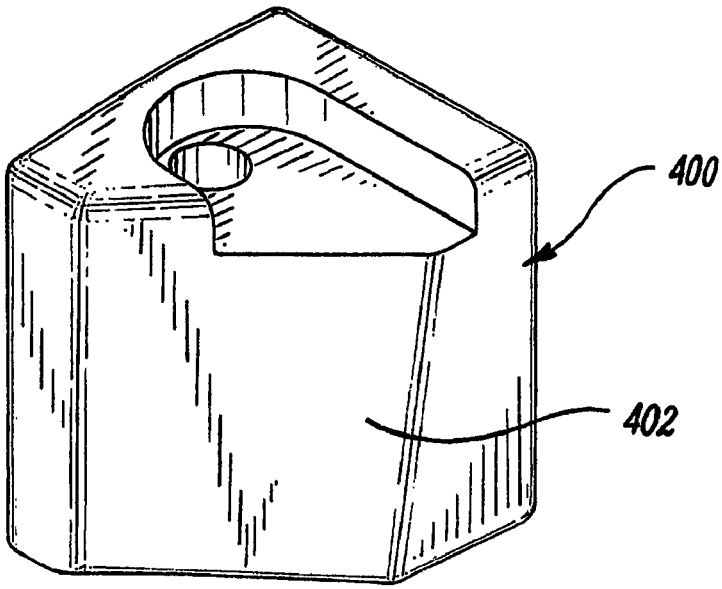
FIG. 10 is a perspective view of a torque key used with the index sleeve of FIG. 9.

FIGS. 9 and 10 show in more detail the indexing mechanism used in accordance with the embodiment of FIGS. 5 to 8. FIG. 9 shows in perspective view an indexing sleeve, generally depicted at 300, provided with a slot 310 having a helical portion 302 and a longitudinal portion 304. The slot 310 is adapted to receive a torque key 400, which follows the path of the slot 310 in use. The torque key 400 stands proud of the slot 310 and keys with an outer sleeve (not shown). In common with other indexing mechanisms, axial motion of one sleeve imparts rotational motion to the other by virtue of the keyed relationship.

In this embodiment, the torque key 400 "floats" in the slot 310, and is biased downwards in the slot 310 by means of a leaf spring. The slot 310 is provided with a changing depth profile to prevent unwanted return of the torque key during actuation. The slot 310 is provided with portions of first depth 305, ramp portions 306, and raised portions 307. The torque key, travelling in the direction of the arrow A, travels up the ramped portion 306 and is then biased downwards. Shoulder 308 prevents return of the torque key into the longitudinal slot, and causes it to travel in the direction of the arrow B, ensuring one way motion. Similar depth profiles are provided in the helical portion of the slot 310.

The torque key is machined to provide a face 402 corresponding to the helical path of the slot. This provides a greater surface area of contact between the key and the slot.

In this embodiment, four such torque keys are used to further increase the contact area and reduce stress during the actuation of the indexing mechanism. This embodiment provides rotation increments of 90 degrees, and thus the valve provides two open positions and two closed positions. It will be appreciated that the indexing mechanism and sealing arrangement of this embodiment could be used with the embodiment of FIG. 1.

The principle advantage of at least one embodiment of the present invention is that it provides a well tubing valve which regulates production and flow rate from several hydrocarbon bearing zones within a well via a single control line.

A further advantage of the present invention is that it provides a dual valve arrangement, operational via rotation of sleeves within the valves so that each valve can be parked in a desired position by simply applying a set number of pressure cycles. Unlike other rotating sleeve arrangements the proposed sealing method provides a spherical seal face i.e. not cylindrical giving normal metal to metal sealing qualities. Further due to the rotating nature of the valve there is no requirement for a double-acting actuator as there is no need for the sleeve to travel in the reverse direction. Yet further as the sleeves rotate there is no loading of axial mounted seals and thus advantageously the valve will be short.

A further advantage to the valve of the present invention is that as the incremental movement of each of the valve members is via a built-in mechanical function, there is no requirement for fluid pulsed accessories to be located individually to each of the ball valves.

As the two ball valves can be manipulated from one control line it will be appreciated that the valve is easily scalable, for example, to three lines controlling six ball valves without complex downhole targeting devices giving a cost-effective way to control flow from individual zones.

A still further advantage of the valve of the present invention is that it provides operators undertaking multi-zone production with the ability to co-mingle or isolate different zones over the life of the well as the valve can remain in the well indefinitely.

It will be appreciated that those skilled in the art that modifications may be made to the invention herein described without departing from the scope thereof. For example the control line may provide an electronic or a radio frequency signal which duly operates the indexing mechanisms. It will also be appreciated that various indexing mechanisms can be incorporated. Yet further the number of apertures within the sleeve and/or the number of ports within the body can be varied as can their relative dimensions to provide the desired flow through cross-sectional areas between the outside of the valve and the bore to surface. It will also be appreciated that the technique of a single control line in combination with ball valves operated through differing incremental steps can be extended from two ball valves to three or more to provide a greater combination of versatility to the valve.

The invention claimed is:

1. A well tubing valve comprising a substantially tubular body having first and second ends adapted for connection in a tubular string; a valve member having at least one aperture and being rotationally moveable relative to the body to align and misalign the at least one aperture in the valve member with a first port in the body to move the valve between an open position and a closed position, wherein the valve member is a sleeve and is actuable to rotate relative to the body in only a single direction; wherein the sleeve includes a part spherical surface and wherein the valve further comprises a sealing arrangement having a seal ring adapted to provide a metal seal wherein the seal ring comprises a complementary spherical surface and is biased to seal against the part spherical surface regardless of differential pressure across the seal ring, wherein the valve member is actuable to be rotated by a fixed degree increment.

2. The valve as claimed in claim 1 wherein the valve member includes a pair of apertures radially oriented and diametrically opposed on the valve member.

3. The valve as claimed in claim 1 wherein the body includes a pair of ports radially oriented and diametrically opposed on the body.

4. The valve as claimed in claim 1 wherein the fixed degree increment is a whole divisor of 360 degrees.

5. The valve as claimed in claim 4 wherein the fixed degree increment is 90 degrees.

6. The valve as claimed in claim 1 further comprising one or more isolation packers.

7. The valve as claimed in claim 1 further comprising a second valve member having at least one aperture and being rotationally moveable relative to the body to align and misalign the at least one aperture in the second valve member with a second port in the body, longitudinally spaced from the first, wherein the second valve is a sleeve and is actuable to rotate relative to the body in a single direction; wherein the sleeve includes a part spherical surface and wherein the valve further comprises a sealing arrangement adapted to provide a metal seal that is biased to seal against the part spherical surface.

8. The valve as claimed in claim 7 wherein the first and second valve members are actuable from a common control line.

9. The valve as claimed in claim 7 wherein at least one of said valve members is actuable to at least three operating positions to incrementally adjust flow through the respective port.

10. The valve as claimed in claim 7 wherein each of said valve members is actuable to at least three operating positions to incrementally adjust flow through the respective port.

11. A well tubing valve, the valve comprising a substantially tubular body having first and second ends adapted for connection in a tubing string; first and second ports located through the body and spaced longitudinally apart; first and second valve members located in the body at the respective ports, each valve member having at least one aperture and being rotationally moveable relative to the body to align and misalign the at least one aperture in the valve member with a respective port in the body to move the valve between an open position and a closed position, wherein each valve member is a sleeve and is actuable to rotate relative to the body in only a single direction; wherein the sleeve includes a part spherical surface and wherein the valve further comprises a sealing arrangement having a seal ring adapted to provide a metal seal wherein the seal ring comprises a complementary spherical surface and is biased to seal against the part spherical surface regardless of differential pressure across the seal ring, each valve member being actuable to at least three operating positions to incrementally adjust flow through the respective port and the valve members being actuable from a common control line, wherein the first valve member has a different number of operational positions than the second valve member.

12. The valve as claimed in claim 11 wherein the operational positions are set by the number of degrees turned by the sleeve on each increment.

13. The valve as claimed in claim 12 wherein the degree increment is a whole divisor of 360 degrees.

14. The valve as claimed in claim 12 wherein the degree increment is selected for each sleeve such that operating positions will exist where both valve members are open, closed and throttled by different amounts.

15. The valve as claimed in claim 11 wherein the common control line is a hydraulic line which connects the two valve members to the surface of the well.

16. The valve as claimed in claim 11 wherein the valve further comprises one or more isolation packers.

17. The valve as claimed in claim 16 wherein a packer is located between each of the ports to isolate the ports from each other.

18. A method of controlling fluid flow from hydrocarbon bearing zones in a well bore, comprising the steps:

(a) locating a well tubing valve in a well bore, the well tubing valve comprising a substantially tubular body having first and second ends adapted for connection in a tubular string; a valve member having at least one aperture and being rotationally moveable relative to the body to align and misalign the at least one aperture in the valve member with a first port in the body to move the valve between an open position and a closed position, wherein the valve member is a sleeve and is actuable to rotate relative to the body in only a single direction; wherein the sleeve includes a part spherical surface and wherein the valve further comprises a sealing arrangement having a seal ring adapted to provide a metal seal wherein the seal ring comprises a complementary spherical surface and is biased to seal against the part spherical surface regardless of differential pressure across the seal ring;

(b) sending a control signal down a control line to the well tubing valve;

(c) actuating the sleeve to cause the sleeve to rotate in only a single direction to move the valve member from an open position in which an aperture in the sleeve is aligned with a port in a tubular body of the valve, to a closed position in which the aperture in the sleeve is misaligned with the port in a tubular body of the valve;

(d) actuating the sleeve to cause the valve member to rotate in only the single direction to move the sleeve from the closed to an open position.

19. A method of controlling fluid flow from hydrocarbon bearing zones in a well bore, comprising the steps:

(a) locating a well tubing valve comprising two valve members across two hydrocarbon producing locations in a well bore, each valve member having at least one aperture and being rotationally moveable relative to a tubular body to align and misalign the at least one aperture in the valve member with a first port in the body to move the valve between an open position and a closed position, wherein each valve member is a sleeve and is actuable to rotate relative to the body in only a single direction; wherein the sleeve includes a part spherical surface and wherein the valve further comprises a sealing arrangement having a seal ring adapted to provide a metal seal wherein the seat ring comprises a complementary spherical surface and is biased to seal against the part spherical surface regardless of differential pressure across the seal ring;

(b) providing a seal between the locations to isolate one from the other;

(c) sending a control signal down a control line to the well tubing valve;

(d) actuating the two valve members together to cause the valve members to move by unequal amounts to thereby vary the fluid flow from each location into the well tubing valve;

(e) repeating steps (c) and (d) until both valve members are open;

(f) repeating steps (c) and (d) until both valve members are closed; and (g) repeating steps (c) and (d) until both valve members are incrementally opened to produce a desired flow rate through each valve member.

20. The method as claimed in claim 19 wherein actuation of the valve members causes them to rotate within the well tubing valve.

21. The method as claimed in claim 19 wherein the method is cyclic so that the combination of valve member positions is repeatable over a predetermined number of control signals.

22. The method as claimed in claim 19 wherein the control signal is a pressure pulse.

* * * * *